US010290296B2

(12) United States Patent
Hendrix et al.

(10) Patent No.: US 10,290,296 B2
(45) Date of Patent: May 14, 2019

(54) FEEDBACK HOWL MANAGEMENT IN ADAPTIVE NOISE CANCELLATION SYSTEM

(71) Applicant: Cirrus Logic International Semiconductor Ltd., Edinburgh (GB)

(72) Inventors: Jon D. Hendrix, Wimberley, TX (US); Jeffrey D. Alderson, Austin, TX (US); Chin Huang Yong, Austin, TX (US); Ryan A. Hellman, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 10 days.

(21) Appl. No.: 15/337,223

(22) Filed: Oct. 28, 2016

(65) Prior Publication Data

US 2017/0133000 A1 May 11, 2017

Related U.S. Application Data

(60) Provisional application No. 62/252,058, filed on Nov. 6, 2015.

(51) Int. Cl.

| | |
|---|---|
| ***H04R 1/10*** | (2006.01) |
| ***G10K 11/178*** | (2006.01) |
| ***H04R 3/00*** | (2006.01) |

(52) U.S. Cl.

CPC .. *G10K 11/17833* (2018.01); *G10K 11/17881* (2018.01); *H04R 1/1083* (2013.01); (Continued)

(58) Field of Classification Search

None

See application file for complete search history.

(56) References Cited

U.S. PATENT DOCUMENTS

2009/0310793 A1* 12/2009 Ohkuri ..... G10L 21/0208 381/58
2013/0329902 A1* 12/2013 Bakalos ..... G10K 11/178 381/71.8

(Continued)

FOREIGN PATENT DOCUMENTS

EP 2842122 A2 3/2015
WO 2016100602 A1 6/2016

OTHER PUBLICATIONS

International Search Report and Written Opinion of the International Searching Authority, International Application No. PCT/US2016/059339, dated Feb. 10, 2017.

*Primary Examiner* — James K Mooney
(74) *Attorney, Agent, or Firm* — Jackson Walker L.L.P.

(57) ABSTRACT

An integrated circuit may include an output for providing an output signal to a transducer including both a source audio signal for playback to a listener and an anti-noise signal for countering the effect of ambient audio sounds in an acoustic output of the transducer, an ambient microphone input for receiving an ambient microphone signal indicative of the ambient audio sounds; an error microphone input for receiving an error microphone signal indicative of the output of the transducer and the ambient audio sounds at the transducer; and a processing circuit that implements a feedback path having a feedback response that generates a feedback anti-noise signal from the error microphone signal, wherein a signal gain of the feedback path is a function of the ambient microphone signal, and wherein the anti-noise signal comprises at least the feedback anti-noise signal.

20 Claims, 5 Drawing Sheets

(52) U.S. Cl.
CPC ..... *H04R 3/005* (2013.01); *G10K 2210/1081* (2013.01); *G10K 2210/3028* (2013.01); *G10K 2210/3056* (2013.01); *G10K 2210/506* (2013.01); *H04R 2410/05* (2013.01); *H04R 2460/01* (2013.01)

(56) References Cited

U.S. PATENT DOCUMENTS

| | | | | |
|---|---|---|---|---|
| 2014/0270223 | A1 | 9/2014 | Li et al. | |
| 2014/0307890 | A1* | 10/2014 | Zhou | H04R 3/002 381/71.11 |
| 2014/0314246 | A1* | 10/2014 | Hellman | G10K 11/16 381/71.11 |
| 2016/0125866 | A1* | 5/2016 | Park | G10K 11/178 381/71.11 |
| 2017/0110105 | A1* | 4/2017 | Kumar | G10K 11/178 |

* cited by examiner

FEEDBACK HOWL MANAGEMENT IN ADAPTIVE NOISE CANCELLATION SYSTEM

RELATED APPLICATIONS

The present disclosure claims priority to U.S. Provisional Patent Application Ser. No. 62/252,058, filed Nov. 6, 2015, which is incorporated by reference herein in its entirety.

FIELD OF DISCLOSURE

The present disclosure relates in general to adaptive noise cancellation in connection with an acoustic transducer, and more particularly, elimination or reduction of feedback howling in an adaptive noise cancellation system.

BACKGROUND

Wireless telephones, such as mobile/cellular telephones, cordless telephones, and other consumer audio devices, such as mp3 players, are in widespread use. Performance of such devices with respect to intelligibility can be improved by providing noise cancelling using a microphone to measure ambient acoustic events and then using signal processing to insert an anti-noise signal into the output of the device to cancel the ambient acoustic events.

A noise cancellation system that uses feedback noise cancellation may suffer from an effect known as "howling." Howling often occurs when a user of a device having noise cancellation places an earbud in such user's ear and adjusts the earbud against the pinna of the ear. Howling often manifests itself audibly as a narrowband sound that continues to grow quickly over a short time. A howl may often occur when the earbud is pressed so tightly against the user's pinna with such a large pressure that the response of the speaker of the earbud becomes stronger in a particular frequency band than was anticipated when the device's feedback noise cancellation system was designed. The howl may go away once the user reduces pressure of the earbud against the pinna. Because howling leads to poor customer experience, systems and methods to reduce or eliminate howling are desired.

SUMMARY

In accordance with the teachings of the present disclosure, certain disadvantages and problems associated with existing approaches to feedback adaptive noise cancellation may be reduced or eliminated.

In accordance with embodiments of the present disclosure, an integrated circuit for implementing at least a portion of a personal audio device may include an output for providing an output signal to a transducer including both a source audio signal for playback to a listener and an anti-noise signal for countering the effect of ambient audio sounds in an acoustic output of the transducer, an ambient microphone input for receiving an ambient microphone signal indicative of the ambient audio sounds; an error microphone input for receiving an error microphone signal indicative of the output of the transducer and the ambient audio sounds at the transducer; and a processing circuit that implements a feedback path having a feedback response that generates a feedback anti-noise signal from the error microphone signal, wherein a signal gain of the feedback path is a function of the ambient microphone signal, and wherein the anti-noise signal comprises at least the feedback anti-noise signal.

In accordance with these and other embodiments of the present disclosure, a method for cancelling ambient audio sounds in the proximity of a transducer may include receiving an ambient microphone signal indicative of the ambient audio sounds, receiving an error microphone signal indicative of the output of the transducer and ambient audio sounds at the transducer, generating an anti-noise signal for countering the effects of ambient audio sounds at an acoustic output of the transducer, wherein generating the anti-noise signal comprises generating a feedback anti-noise signal from the error microphone signal with a feedback path having a feedback response, wherein a signal gain of the feedback path is a function of the ambient microphone signal, and wherein the anti-noise signal comprises at least the feedback anti-noise signal, and combining the anti-noise signal with a source audio signal to generate an audio signal provided to the transducer.

Technical advantages of the present disclosure may be readily apparent to one of ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

The present disclosure encompasses noise cancelling techniques and circuits that can be implemented in a personal audio device, such as a wireless telephone. The personal audio device includes an ANC circuit that may measure the ambient acoustic environment and generate a signal that is injected in the speaker (or other transducer) output to cancel ambient acoustic events. A reference microphone may be provided to measure the ambient acoustic environment, and an error microphone may be included for controlling the adaptation of the anti-noise signal to cancel the ambient audio sounds and for correcting for the electro-acoustic path from the output of the processing circuit through the transducer.

Figure 1A:
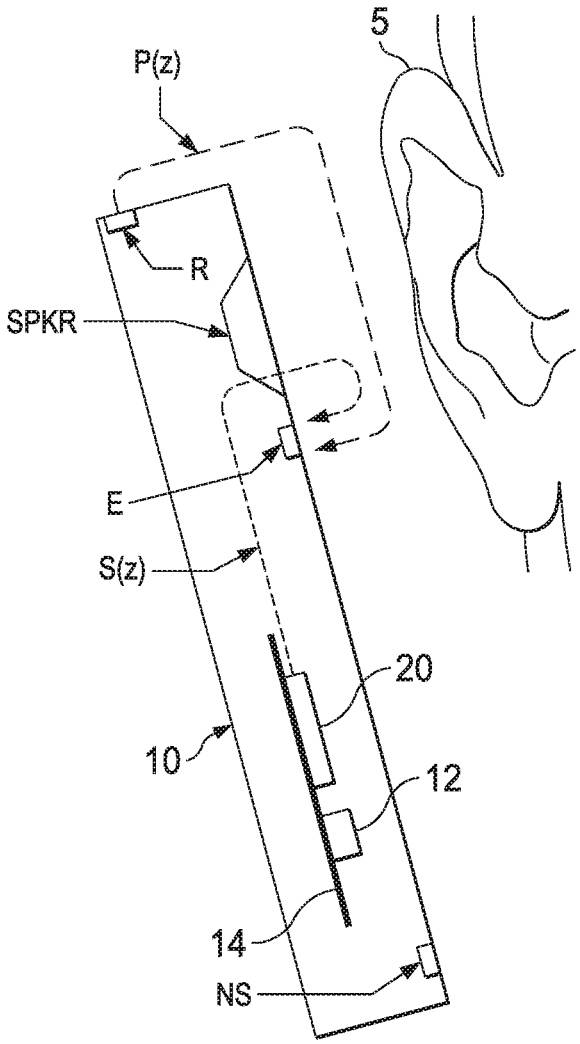
FIG. 1A is an illustration of an example wireless mobile telephone, in accordance with embodiments of the present disclosure.

Referring now to FIG. 1A, a wireless telephone 10 as illustrated in accordance with embodiments of the present disclosure is shown in proximity to a human ear 5. Wireless telephone 10 is an example of a device in which techniques in accordance with embodiments of this disclosure may be employed, but it is understood that not all of the elements or configurations embodied in illustrated wireless telephone 10, or in the circuits depicted in subsequent illustrations, are required in order to practice the inventions recited in the claims. Wireless telephone 10 may include a transducer, such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. A near-speech microphone NS may be provided to capture near-end speech, which is transmitted from wireless telephone 10 to the other conversation participant(s).

Wireless telephone 10 may include ANC circuits and features that inject an anti-noise signal into speaker SPKR to improve intelligibility of the distant speech and other audio reproduced by speaker SPKR. A reference microphone R may be provided for measuring the ambient acoustic environment, and may be positioned away from the typical position of a user's mouth, so that the near-end speech may be minimized in the signal produced by reference microphone R. Another microphone, error microphone E, may be provided in order to further improve the ANC operation by providing a measure of the ambient audio combined with the audio reproduced by speaker SPKR close to ear 5, when wireless telephone 10 is in close proximity to ear 5. In other embodiments, additional reference and/or error microphones may be employed. Circuit 14 within wireless telephone 10 may include an audio CODEC integrated circuit (IC) 20 that receives the signals from reference microphone R, near-speech microphone NS, and error microphone E and interfaces with other integrated circuits, such as a radio-frequency (RF) integrated circuit 12 having a wireless telephone transceiver. In some embodiments of the disclosure, the circuits and techniques disclosed herein may be incorporated in a single integrated circuit that includes control circuits and other functionality for implementing the entirety of the personal audio device, such as an MP3 player-on-a-chip integrated circuit. In these and other embodiments, the circuits and techniques disclosed herein may be implemented partially or fully in software and/or firmware embodied in computer-readable media and executable by a controller or other processing device.

In general, ANC techniques of the present disclosure measure ambient acoustic events (as opposed to the output of speaker SPKR and/or the near-end speech) impinging on reference microphone R, and by also measuring the same ambient acoustic events impinging on error microphone E, ANC processing circuits of wireless telephone 10 adapt an anti-noise signal generated from the output of reference microphone R to have a characteristic that minimizes the amplitude of the ambient acoustic events at error microphone E. Because acoustic path P(z) extends from reference microphone R to error microphone E, ANC circuits are effectively estimating acoustic path P(z) while removing effects of an electro-acoustic path S(z) that represents the response of the audio output circuits of CODEC IC 20 and the acoustic/electric transfer function of speaker SPKR including the coupling between speaker SPKR and error microphone E in the particular acoustic environment, which may be affected by the proximity and structure of ear 5 and other physical objects and human head structures that may be in proximity to wireless telephone 10, when wireless telephone 10 is not firmly pressed to ear 5. While the illustrated wireless telephone 10 includes a two-microphone ANC system with a third near-speech microphone NS, some aspects of the present invention may be practiced in a system that does not include separate error and reference microphones, or a wireless telephone that uses near-speech microphone NS to perform the function of the reference microphone R. Also, in personal audio devices designed only for audio playback, near-speech microphone NS will generally not be included, and the near-speech signal paths in the circuits described in further detail below may be omitted, without changing the scope of the disclosure, other than to limit the options provided for input to the microphone.

Figure 1B:
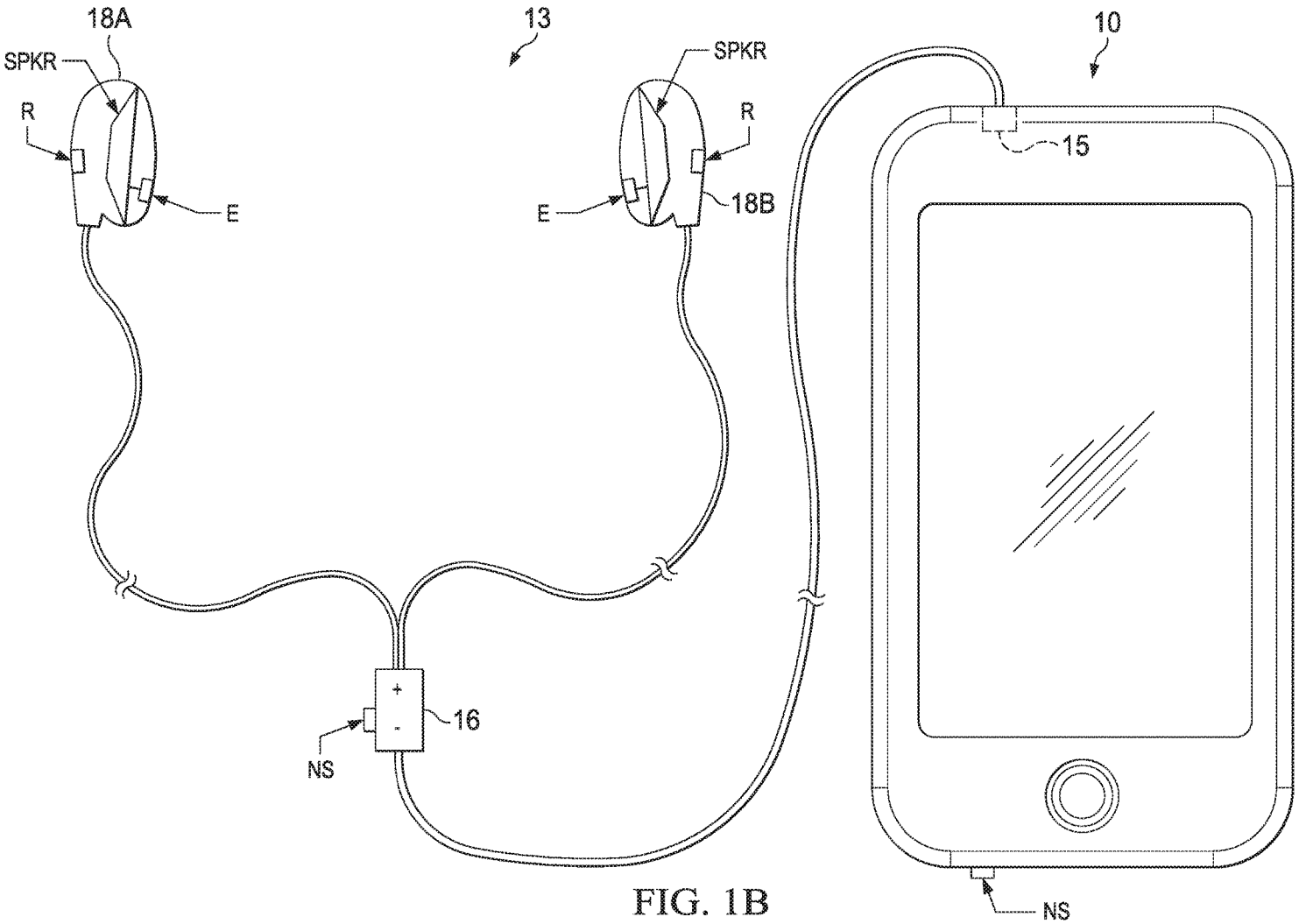
FIG. 1B is an illustration of an example wireless mobile telephone with a headphone assembly coupled thereto, in accordance with embodiments of the present disclosure.

Referring now to FIG. 1B, wireless telephone 10 is depicted having a headphone assembly 13 coupled to it via audio port 15. Audio port 15 may be communicatively coupled to RF integrated circuit 12 and/or CODEC IC 20, thus permitting communication between components of headphone assembly 13 and one or more of RF integrated circuit 12 and/or CODEC IC 20. As shown in FIG. 1B, headphone assembly 13 may include a combox 16, a left headphone 18A, and a right headphone 18B. In some embodiments, headphone assembly 13 may comprise a wireless headphone assembly, in which case all or some portions of CODEC IC 20 may be present in headphone assembly 13, and headphone assembly 13 may include a wireless communication interface (e.g., BLUETOOTH) in order to communicate between headphone assembly 13 and wireless telephone 10.

As used in this disclosure, the term "headphone" broadly includes any loudspeaker and structure associated therewith that is intended to be mechanically held in place proximate to a listener's ear canal, and includes without limitation earphones, earbuds, and other similar devices. As more specific examples, "headphone" may refer to intra-concha earphones, supra-concha earphones, and supra-aural earphones.

Combox 16 or another portion of headphone assembly 13 may have a near-speech microphone NS to capture near-end speech in addition to or in lieu of near-speech microphone NS of wireless telephone 10. In addition, each headphone 18A, 18B may include a transducer such as speaker SPKR that reproduces distant speech received by wireless telephone 10, along with other local audio events such as ringtones, stored audio program material, injection of near-end speech (i.e., the speech of the user of wireless telephone 10) to provide a balanced conversational perception, and other audio that requires reproduction by wireless telephone 10, such as sources from webpages or other network communications received by wireless telephone 10 and audio indications such as a low battery indication and other system event notifications. Each headphone 18A, 18B may include a reference microphone R for measuring the ambient acoustic environment and an error microphone E for measuring of the ambient audio combined with the audio reproduced by speaker SPKR close to a listener's ear when such headphone 18A, 18B is engaged with the listener's ear. In some embodiments, CODEC IC 20 may receive the signals from reference microphone R and error microphone E of each headphone and near-speech microphone NS, and perform adaptive noise cancellation for each headphone as described herein. In other embodiments, a CODEC IC or another circuit may be present within headphone assembly 13, communicatively coupled to reference microphone R, near-speech microphone NS, and error microphone E, and configured to perform adaptive noise cancellation as described herein.

Figure 2:
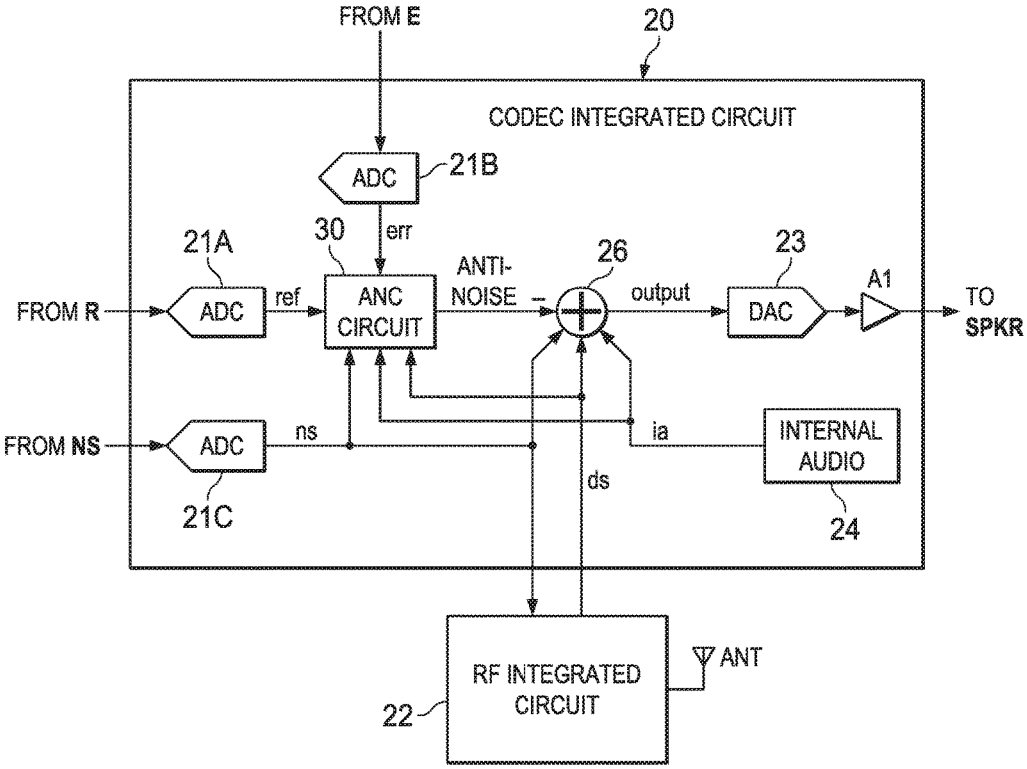
FIG. 2 is a block diagram of selected circuits within the wireless mobile telephone depicted in FIG. 1, in accordance with embodiments of the present disclosure.

Referring now to FIG. 2, selected circuits within wireless telephone 10 are shown in a block diagram, which in other embodiments may be placed in whole or in part in other locations such as one or more headphones or earbuds. CODEC IC 20 may include an analog-to-digital converter (ADC) 21A for receiving the reference microphone signal from microphone R and generating a digital representation ref of the reference microphone signal, an ADC 21B for receiving the error microphone signal from error microphone E and generating a digital representation err of the error microphone signal, and an ADC 21C for receiving the near speech microphone signal from near speech microphone NS and generating a digital representation ns of the near speech microphone signal. CODEC IC 20 may generate an output for driving speaker SPKR from an amplifier A1, which may amplify the output of a digital-to-analog converter (DAC) 23 that receives the output of a combiner 26. Combiner 26 may combine audio signals is from internal audio sources 24, the anti-noise signal generated by ANC circuit 30, which by convention has the same polarity as the noise in reference microphone signal ref and is therefore subtracted by combiner 26, and a portion of near speech microphone signal ns so that the user of wireless telephone 10 may hear his or her own voice in proper relation to downlink speech ds, which may be received from radio frequency (RF) integrated circuit 22 and may also be combined by combiner 26. Near speech microphone signal ns may also be provided to RF integrated circuit 22 and may be transmitted as uplink speech to the service provider via antenna ANT.

Figure 3:
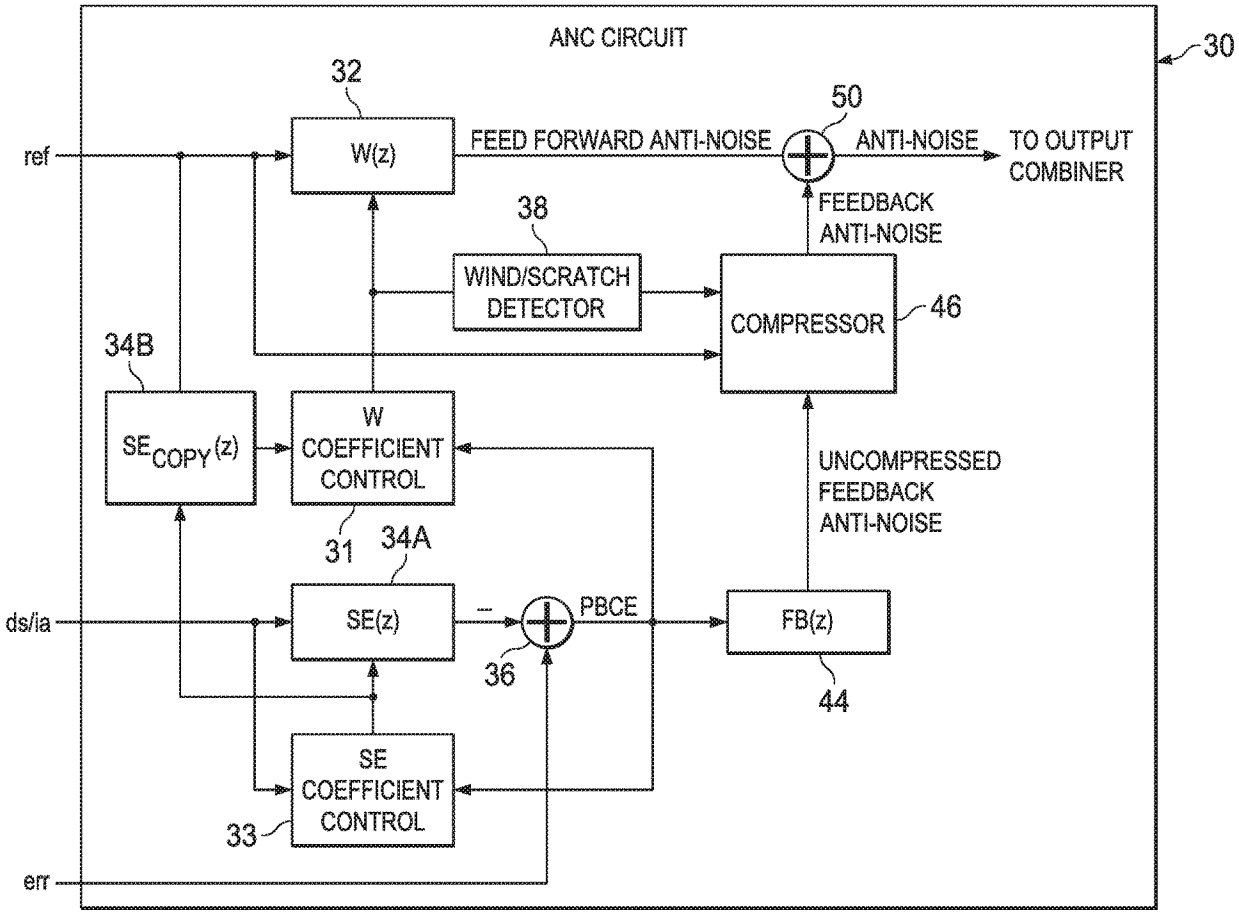
FIG. 3 is a block diagram depicting selected signal processing circuits and functional blocks within an example adaptive noise cancelling (ANC) circuit of a coder-decoder (CODEC) integrated circuit of FIG. 2 which uses feedforward filtering and feedback filtering to generate an anti-noise signal, in accordance with embodiments of the present disclosure.

Referring now to FIG. 3, details of ANC circuit 30 which may be used to implement ANC circuit 30 are shown in accordance with embodiments of the present disclosure. Adaptive filter 32 may receive reference microphone signal ref and under ideal circumstances, may adapt its transfer function W(z) to be P(z)/S(z) to generate a feedforward anti-noise component of the anti-noise signal, which may be combined by combiner 50 with a feedback anti-noise component of the anti-noise signal (described in greater detail below) to generate an anti-noise signal which in turn may be provided to an output combiner that combines the anti-noise signal with the source audio signal to be reproduced by the transducer, as exemplified by combiner 26 of FIG. 2. The coefficients of adaptive filter 32 may be controlled by a W coefficient control block 31 that uses a correlation of signals to determine the response of adaptive filter 32, which generally minimizes the error, in a least-mean squares sense, between those components of reference microphone signal ref present in error microphone signal err. The signals compared by W coefficient control block 31 may be the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing the ambient audio sounds in the error microphone signal, adaptive filter 32 may adapt to the desired response of P(z)/S(z). In addition to error microphone signal err, the signal compared to the output of filter 34B by W coefficient control block 31 may include an inverted amount of downlink audio signal ds and/or internal audio signal ia that has been processed by filter response SE(z), of which response $SE_{COPY}(z)$ is a copy. By injecting an inverted amount of downlink audio signal ds and/or internal audio signal ia, adaptive filter 32 may be prevented from adapting to the relatively large amount of downlink audio and/or internal audio signal present in error microphone signal err. However, by transforming that inverted copy of downlink audio signal ds and/or internal audio signal ia with the estimate of the response of path S(z), the downlink audio and/or internal audio that is removed from error microphone signal err should match the expected version of downlink audio signal ds and/or internal audio signal ia reproduced at error microphone signal err, because the electrical and acoustical path of S(z) is the path taken by downlink audio signal ds and/or internal audio signal ia to arrive at error microphone E. Filter 34B may not be an adaptive filter, per se, but may have an adjustable response that is tuned to match the response of adaptive filter 34A, so that the response of filter 34B tracks the adapting of adaptive filter 34A.

To implement the above, adaptive filter 34A may have coefficients controlled by SE coefficient control block 33, which may compare downlink audio signal ds and/or internal audio signal ia and error microphone signal err after removal of the above-described filtered downlink audio signal ds and/or internal audio signal ia, that has been filtered by adaptive filter 34A to represent the expected downlink audio delivered to error microphone E, and which is removed from the output of adaptive filter 34A by a combiner 36 to generate a playback-corrected error, shown as PBCE in FIG. 3. SE coefficient control block 33 may correlate the actual downlink speech signal ds and/or internal audio signal ia with the components of downlink audio signal ds and/or internal audio signal ia that are present in error microphone signal err. Adaptive filter 34A may thereby be adapted to generate a signal from downlink audio signal ds and/or internal audio signal ia, that when subtracted from error microphone signal err, contains the content of error microphone signal err that is not due to downlink audio signal ds and/or internal audio signal ia.

As depicted in FIG. 3, ANC circuit 30 may also comprise feedback filter 44. Feedback filter 44 may receive the playback corrected error signal PBCE and may apply a filter response FB(z) to generate a feedback signal based on the playback corrected error. Also as depicted in FIG. 3, a feedback path of the feedback anti-noise component may have a compressor 46 in series with feedback filter 44 such that the product of filter response FB(z) and a compressor response of compressor 46 (described in greater detail below) is applied to playback corrected error signal PBCE in order to generate the feedback anti-noise component of the anti-noise signal. Thus, together feedback filter 44 and compressor 46 form a feedback path having a feedback response (e.g., product of filter response FB(z) and the compressor response of compressor 46) that generates a feedback anti-noise signal based on the error microphone signal (e.g., playback corrected error signal PBCE). Thus, feedback filter 44 generates an uncompressed feedback anti-noise signal from the error microphone signal and compressor 46 generates a feedback anti-noise signal from the uncompressed feedback anti-noise signal in accordance with the compressor response of compressor 46.

The feedback anti-noise component of the anti-noise signal may be combined by combiner 50 with the feedforward anti-noise component of the anti-noise signal to generate the anti-noise signal which in turn may be provided to an output combiner that combines the anti-noise signal with the source audio signal to be reproduced by the transducer, as exemplified by combiner 26 of FIG. 2.

Figure 4:
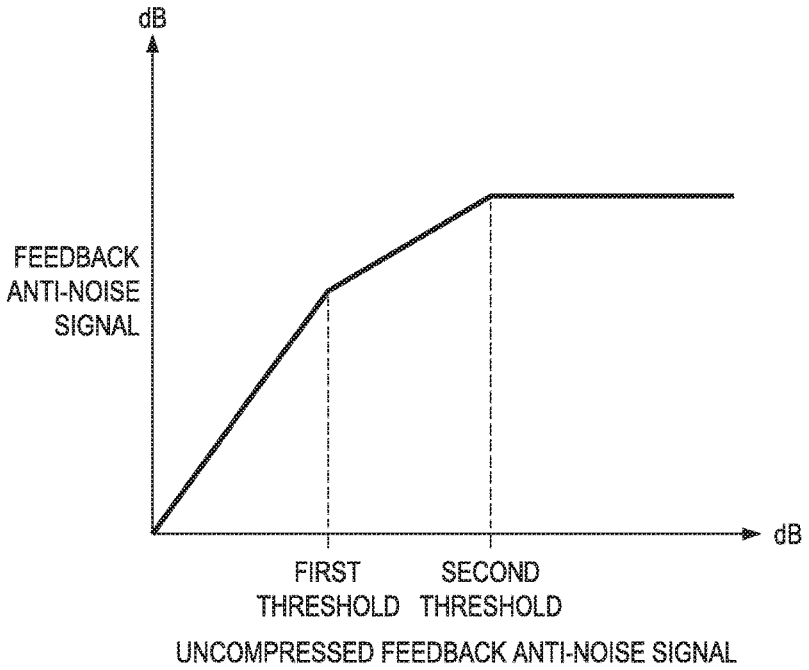
FIG. 4 is a graph depicting an example compressor response of the compressor depicted in FIG. 3, in accordance with embodiments of the present disclosure.

In operation, a response of compressor 46 may generally be represented by the curve depicted in FIG. 4. For example, as shown in FIG. 4, as the uncompressed feedback anti-noise signal generated by feedback filter 44 increases, compressor 46 may attenuate a gain of compressor 46 and/or may limit the compressed feedback anti-noise signal generated by compressor 46. For example, in the example graph depicted in FIG. 4, compressor 46 may operate in three regions. Compressor 46 may operate in a first region when the magnitude of the uncompressed feedback anti-noise signal is below a first threshold as shown in FIG. 4, a second region when the magnitude of the uncompressed feedback anti-noise signal is between the first threshold and a second threshold as shown in FIG. 4, and a third region when the magnitude of the uncompressed feedback anti-noise signal is above the second threshold as shown in FIG. 4. In the first region, compressor 46 may not apply any attenuation to the uncompressed feedback anti-noise signal such that for magnitudes of the uncompressed feedback anti-noise signal below the first threshold, the compressor 46 generates a compressed feedback anti-noise signal approximately equal to that of the uncompressed feedback anti-noise signal. In other words, in the first region, compressor 46 may apply a unity gain to the uncompressed feedback anti-noise signal. In the second region, compressor 46 may apply a finite attenuation to uncompressed feedback anti-noise signal, such that for magnitudes of the uncompressed feedback anti-noise signal between the first threshold and the second threshold, the corresponding magnitude of the compressed feedback anti-noise signal generated by compressor 46 is substantially smaller than that of the uncompressed feedback anti-noise signal. In the third region, compressor 46 may apply a level of attenuation (e.g. up to and including infinite attenuation) so as to apply a limit to the compressed feedback anti-noise signal. Thus, in the third region, for magnitudes of the uncompressed feedback anti-noise signal above the second threshold, compressor 46 will attenuate the uncompressed feedback anti-noise signal so as to limit compressed feedback anti-noise signal to a maximum magnitude.

By applying compressor 46 within the feedback path of ANC circuit 30, compressor 46 may reduce or eliminate howling, as when howling occurs, high magnitudes associated with the howling may be attenuated or limited by compressor 46. However, if the first threshold and second threshold shown in FIG. 4 were fixed, the feedback path of ANC circuit 30 may not adequately provide feedback-based noise cancellation when in the presence of ambient noise with high magnitudes, as compressor 46 may attenuate or limit the feedback anti-noise needed to effectively cancel ambient noise. Accordingly, the first threshold and second threshold of the compressor response of compressor 46 may be variable and controllable based on reference microphone signal ref or another microphone signal indicative of ambient audio sounds. Thus, the compressor response is not only a function of the uncompressed anti-noise signal (and thus a function of the error microphone signal from which playback corrected error signal PBCE and the uncompressed anti-noise signal are generated), but also a function of an ambient microphone signal (e.g., reference microphone signal ref) indicative of ambient audio sounds.

Figure 5:
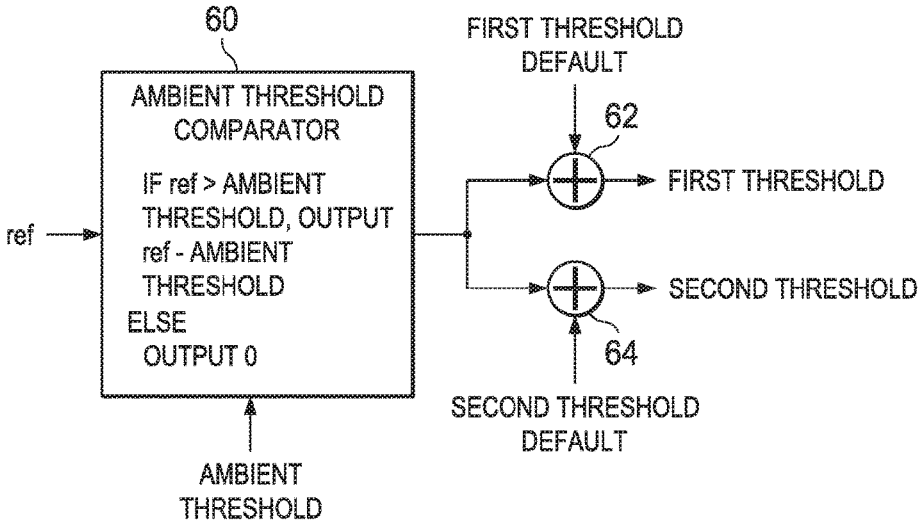
FIG. 5 is a block diagram depicting selected components of the compressor depicted in FIG. 3, in accordance with embodiments of the present disclosure.

FIG. 5 is a block diagram depicting selected components of compressor 46, in accordance with embodiments of the present disclosure. In embodiments of compressor 46 represented by FIG. 5, compressor 46 may comprise an ambient threshold comparator 60 which may compare a magnitude of reference microphone signal ref to a predetermined ambient threshold level, output the difference between the magnitude of reference microphone signal ref to the predetermined ambient threshold level if the magnitude of reference microphone signal ref exceeds the predetermined ambient threshold level, and output zero otherwise. Compressor 46 may, as exemplified by combiner 62, add the output of ambient threshold comparator 60 to a default value of the first threshold to set the first threshold of the compressor 46 as shown in FIG. 4. Compressor 46 may also, as exemplified by combiner 64, add the output of ambient threshold comparator 60 to a default value of the second threshold to set the second threshold of the compressor 46 as shown in FIG. 4. Thus, when reference microphone signal ref has a magnitude above the ambient threshold, the first threshold and the second threshold increase based on an amount of increase of the ambient magnitude above the ambient threshold. In addition, as shown in FIG. 5, in some embodiments the first threshold and the second threshold may increase at an approximately equal amount for a given amount of increase of the magnitude of reference microphone signal ref above the ambient threshold.

Turning again to FIG. 3, ANC circuit 30 may include wind/scratch detector 38. Wind/scratch detector 38 may comprise any suitable system, device, or apparatus configured to detect when wind or other mechanical noise (as opposed to acoustic ambient noise) is present at reference microphone R. For example, wind/scratch detector 38 may, as described in U.S. Pat. No. 9,230,532 by Yang Lu et al., granted Jan. 5, 2016, entitled "Power Management of Adaptive Noise Cancellation (ANC) in a Personal Audio Device" (which is incorporated by reference herein), compute a time derivative of the sum $\Sigma|W_n(z)|$ of the magnitudes of the coefficients $W_n(z)$ that shape the response of adaptive filter 32, which is an indication of a variation in overall gain of the response of adaptive filter 32. Large variations in sum $\Sigma|W_n(z)|$ may indicate mechanical noise such as that produced by wind incident on reference microphone R or varying mechanical contact (e.g., scratching) on a housing of wireless telephone 10, or other conditions such as an adaptation step size that is too large and causes unstable operation has been used in the system. Wind/scratch detector 38 may compare a time derivative of sum $\Sigma|W_n(z)|$ to a threshold to determine when mechanical noise is present, and may provide an indication of the presence of mechanical noise to compressor 46 while the mechanical noise condition exists. While wind/scratch detector 38 provides one example of wind/scratch measurement, other alternative techniques for detecting wind and/or mechanical noise could be used to provide such an indication to compressor 46. In the presence of mechanical noise, compressor 46 may refrain from modifying the first threshold and the second threshold, such that such thresholds are modified only in the presence of acoustic noise above the ambient threshold level.

Although feedback filter 44 and compressor 46 are shown as separate components of ANC circuit 30, in some embodiments some structure and/or function of feedback filter 44 and compressor 46 may be combined.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. An integrated circuit for implementing at least a portion of a personal audio device, comprising:

an output for providing an output signal to a transducer including both a source audio signal for playback to a listener and an anti-noise signal for countering the effect of ambient audio sounds in an acoustic output of the transducer;

an ambient microphone input for receiving an ambient microphone signal indicative of the ambient audio sounds;

an error microphone input for receiving an error microphone signal indicative of the output of the transducer and the ambient audio sounds at the transducer; and a processing circuit that implements a feedback path comprising a compressor having a compressor response in series with a feedback filter having a filter response such that the feedback path has a feedback response which is a product of the compressor response and the filter response and generates a feedback anti-noise signal from the error microphone signal, wherein:

the compressor response is a function of the ambient microphone signal; and the anti-noise signal comprises at least the feedback anti-noise signal.

2. The integrated circuit of claim 1, wherein:

the filter response generates an uncompressed feedback anti-noise signal from the error microphone signal; and the compressor response generates the feedback anti-noise signal from the uncompressed feedback anti-noise signal, wherein the compressor response is a function of the ambient microphone signal.

3. The integrated circuit of claim 2, wherein the compressor response comprises at least one threshold for gain attenuation which is a function of the ambient microphone signal.

4. The integrated circuit of claim 3, wherein the at least one threshold for gain attenuation comprises a first threshold magnitude of the uncompressed feedback anti-noise signal above which a first gain attenuation is applied and a second threshold magnitude of the uncompressed feedback anti-noise signal above which a second gain attenuation is applied, and wherein the first threshold and the second threshold are functions of the ambient microphone signal.

5. The integrated circuit of claim 4, wherein when the ambient microphone signal has an ambient magnitude above an ambient threshold, the first threshold and the second threshold increase based on an amount of increase of the ambient magnitude above the ambient threshold.

6. The integrated circuit of claim 5, wherein the first threshold and the second threshold increase an approximately equal amount for a given amount of increase of the ambient magnitude above the ambient threshold.

7. The integrated circuit of claim 3, wherein the compressor ceases updating the at least one threshold for gain attenuation when mechanical noise is present in the ambient microphone signal.

8. The integrated circuit of claim 1, wherein the processing circuit further implements a feedforward filter having a feedforward response that generates at least a portion of the anti-noise signal from the ambient microphone signal.

9. The integrated circuit of claim 8, wherein the processing circuit further implements a feedforward coefficient control block that shapes the feedforward response of the feedforward filter by adapting the feedforward response of the feedforward filter to minimize the ambient audio sounds in the error microphone signal.

10. The integrated circuit of claim 1, wherein the processing circuit further implements:

a secondary path estimate filter configured to model an electro-acoustic path of the source audio signal and having a secondary response that generates a secondary path estimate from the source audio signal; and a secondary path estimate coefficient control block that shapes the secondary response of the secondary path estimate filter in conformity with the source audio signal and a playback corrected error by adapting the secondary response of the secondary path estimate filter to minimize a playback corrected error, wherein the playback corrected error is based on a difference between the error microphone signal and the secondary path estimate.

11. A method for cancelling ambient audio sounds in the proximity of a transducer, comprising:

receiving an ambient microphone signal indicative of the ambient audio sounds;

receiving an error microphone signal indicative of the output of the transducer and ambient audio sounds at the transducer;

generating an anti-noise signal for countering the effects of ambient audio sounds at an acoustic output of the transducer, wherein generating the anti-noise signal comprises generating a feedback anti-noise signal from the error microphone signal with a feedback path comprising a compressor having a compressor response in series with a feedback filter having a filter response such that the feedback path has a feedback response which is a product of the compressor response and the filter response, wherein the compressor response is a function of the ambient microphone signal, and wherein the anti-noise signal comprises at least the feedback anti-noise signal; and combining the anti-noise signal with a source audio signal to generate an audio signal provided to the transducer.

12. The method of claim 11, wherein generating a feedback anti-noise signal comprises:

generating an uncompressed feedback anti-noise signal from the error microphone signal by the feedback filter with the filter response; and generating the feedback anti-noise signal from the uncompressed feedback anti-noise signal by the compressor with the compressor response.

13. The method of claim 12, wherein the compressor response comprises at least one threshold for gain attenuation which is a function of the ambient microphone signal.

14. The method of claim 13, wherein the at least one threshold for gain attenuation comprises a first threshold magnitude of the uncompressed feedback anti-noise signal above which a first gain attenuation is applied and a second threshold magnitude of the uncompressed feedback anti-noise signal above which a second gain attenuation is applied, and wherein the first threshold and the second threshold are functions of the ambient microphone signal.

15. The method of claim 14, wherein when the ambient microphone signal has an ambient magnitude above an ambient threshold, the first threshold and the second threshold increase based on an amount of increase of the ambient magnitude above the ambient threshold.

16. The method of claim 15, wherein the first threshold and the second threshold increase an approximately equal amount for a given amount of increase of the ambient magnitude above the ambient threshold.

17. The method of claim 13, further comprising ceasing updating of at least one threshold for gain attenuation when mechanical noise is present in the ambient microphone signal.

18. The method of claim 11, further comprising generating at least a portion of the anti-noise signal from the ambient microphone signal with a feedforward filter having a feedforward response.

19. The method of claim 18, further comprising shaping the feedforward response of the feedforward filter by adapting the feedforward response of the feedforward filter to minimize the ambient audio sounds in the error microphone signal.

20. The method of claim 11, further comprising:

generating a secondary path estimate from the source audio signal by filtering the source audio signal with a secondary path estimate filter modeling an electro-acoustic path of the source audio signal; and adapting the secondary path estimate filter to minimize a playback corrected error, wherein the playback corrected error is based on a difference between the error microphone signal and the secondary path estimate.

* * * * *